US006255748B1

(12) United States Patent
Allcorn

(10) Patent No.: US 6,255,748 B1
(45) Date of Patent: Jul. 3, 2001

(54) SWITCH STATUS SENSOR

(75) Inventor: Roger Allcorn, Basingstoke (GB)

(73) Assignee: Fusion Meters Limited, Birmingham (GB)

( * ) Notice: Subject to any disclaimer, the term of this patent is extended or adjusted under 35 U.S.C. 154(b) by 0 days.

(21) Appl. No.: 09/101,691

(22) PCT Filed: Jan. 9, 1997

(86) PCT No.: PCT/GB97/00056

§ 371 Date: Dec. 1, 1998

§ 102(e) Date: Dec. 1, 1998

(87) PCT Pub. No.: WO97/25729

PCT Pub. Date: Jul. 17, 1997

(30) Foreign Application Priority Data

Jan. 11, 1996 (GB) ..... 9600493

(51) Int. Cl.[7] ..... H01H 9/16

(52) U.S. Cl. ..... 307/125; 307/112; 307/131; 340/644; 377/21

(58) Field of Search ..... 307/112, 113, 307/116, 125, 126, 130, 131; 324/418, 419, 424, 500, 512, 522, 523; 361/78, 79, 86, 87, 139, 152, 154, 160, 170, 187–190; 340/644; 377/19, 21, 28–30, 55, 111

(56) References Cited

U.S. PATENT DOCUMENTS

| | | | | |
|---|---|---|---|---|
| 4,031,362 | | 6/1977 | Brugger et al. . | |
| 4,134,026 | | 1/1979 | Sone et al. . | |
| 4,710,645 | * | 12/1987 | Doittan et al. | 307/115 |
| 4,757,417 | * | 7/1988 | Futsuhara | 361/86 |
| 4,864,285 | * | 9/1989 | Rodden | 340/644 |
| 5,031,110 | * | 7/1991 | Yocom | 364/481 |
| 5,053,911 | * | 10/1991 | Kopec et al. | 361/154 |
| 5,341,029 | * | 8/1994 | Johnson | 307/112 |
| 5,347,419 | * | 9/1994 | Caron et al. | 361/154 |
| 5,455,733 | * | 10/1995 | Waggamon | 307/132 E |
| 5,506,573 | * | 4/1996 | Ewing et al. | 340/644 |
| 5,784,245 | * | 7/1998 | Moraghan et al. | 361/154 |

FOREIGN PATENT DOCUMENTS

| | | |
|---|---|---|
| 3941319 A1 | 6/1991 | (DE) . |
| 9206932 U1 | 8/1992 | (DE) . |
| 0327403 A2 | 8/1989 | (EP) . |
| 0573771 A1 | 12/1993 | (EP) . |
| 2171544 | 8/1986 | (GB) . |
| 012218716 | 9/1989 | (JP) . |

* cited by examiner

*Primary Examiner*—Fritz Fleming
(74) *Attorney, Agent, or Firm*—Collen Law Associates PC; Robert M. McDermott

(57) ABSTRACT

A switch status sensor is provided for counting on/off events of a switch of a water meter. When an on/off event is detected by a microcontroller, the microcontroller supplies a "signature" signal, which is distinguishable from electromagnetic noise, to the switch. If this "signature" signal is detected as having passed through the switch by the microcontroller, then it can be confirmed that the switch is closed. Alternatively, if the "signature" signal is not detected as having passed through the switch by the microcontroller, then it is verified that the switch is open. Thus, the switch status sensor can distinguish between false switch events caused by electromagnetic noise and true on/off events of the switch.

17 Claims, 1 Drawing Sheet

SWITCH STATUS SENSOR

FIELD OF THE INVENTION

The present invention relates to a switch status sensor and more particularly, but not exclusively, to a switch status sensor for use in a water meter to reliably measure the consumption of water, or in any other type of meter which is responsive to the status changes of a switch.

BACKGROUND OF THE INVENTION

When a switch changes its state the voltages and currents in connections made to the switch are changed and the changes can be sensed by suitable apparatus to determine the status of the switch. Errors can occur in areas of high electromagnetic noise when current or voltage changes may be induced in the connections which are sensed by the apparatus and give a false indication of the status of the switch. Such errors are particularly undesirable in water meters, as they would result in a consumer being over or undercharged.

Conventionally, because switch status sensors which count the number of pulses received from a switch-type water meter are subject to electromagnetic radiation, which can cause miscounting of switching events, the signals received from the switch are heavily filtered. However, this has the negative effect of slowing down the responsiveness, with the ultimate effect of missing real switch closures. The requirements for achieving fast response and electromagnetic noise immunity are irreconcilable using filtering alone.

SUMMARY AND OBJECTS OF THE INVENTION

The present invention aims to provide a sensor which can discriminate between signals received following a change of status of a switch and noise signals and/or which has a fast response time.

According to a first aspect of the present invention there is provided a switch status sensor for connection to a switch, the switch status sensor comprising current responsive means responsive to a current which apparently indicates a given switch status, means for applying a signal distinguishable from electromagnetic noise to said switch, and means for detecting the passage of said signal through said switch to determine the status of said switch, and wherein the means for applying said signal applies said signal to said switch in response to an indication from said current responsive means.

According to a second aspect of the invention there is provided a switch status sensor circuit adapted for connection to an electrical switch, means responsive to an electrical current flowing through said connection from the switch to determine changes in the status of the switch and means responsive to a current which apparently indicates a given switch status for supplying a special signal to the switch and sensing a passage of that signal through the switch to test whether the indicated status is correct said special signal being distinguishable from electromagnetic noise.

The signal supply and current testing is preferably performed by a microcontroller. A filter may be provided for filtering the current received through said connection, and means may be provided for disabling said filter during the testing of said given signal.

In one embodiment, the switch to be monitored changes its state in response to various events, for example the passage of a given volume of water through a water meter.

By counting the number of times the switch opens and closes, a count of the water flow is obtained. If the circuit which monitors the state of the switch is subject to electromagnetic noise, then the count obtained from the switch may be inaccurate. The switch status sensor applies a signal distinguishable from electromagnetic noise to the switch, and means is provided for detecting the passage of the signal through the switch in order that the true status of the switch can be determined even if electromagnetic noise is present.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 1:
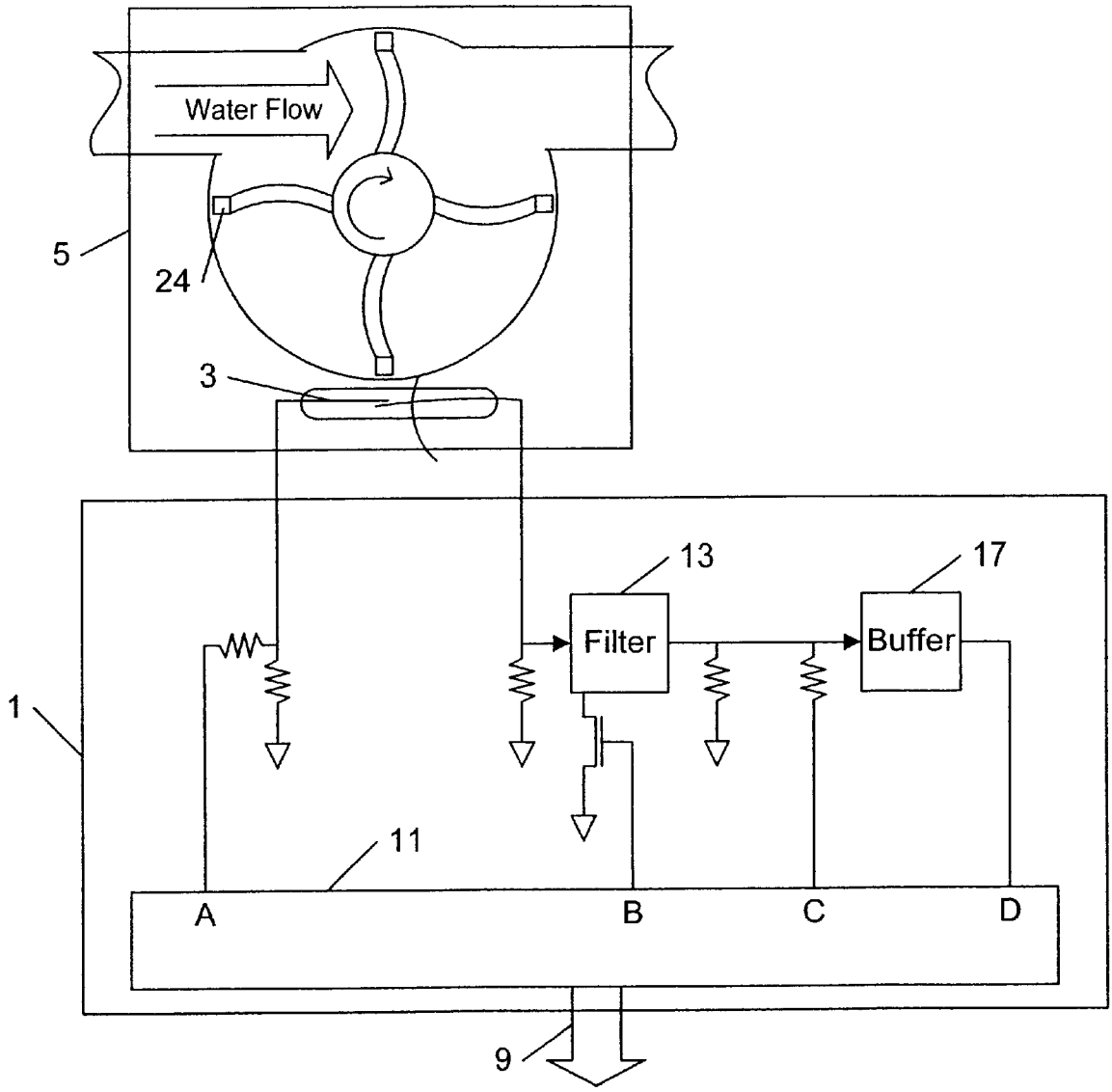
FIG. 1 is a microcontroller connected through various components to a switch whose status is to be monitored.

The switch status sensor indicated generally at 1 in FIG. 1 is connected to a micro/reed type switch 3 of a water meter, indicated generally at 5. The water meter 5 may be a switch or pulse-type water meter. The switch 3 opens and closes once to indicate that a unit measure of water has been consumed. In the example illustrated water meter 5, a magnet 24 causes the reed switch 3 to close each time it passes in proximity to the reed switch 3.

The switch status sensor 1 is a self-contained unit being powered from its own internal batteries and is fully environmentally sealed. The switch status sensor 1 has two interfaces: an interface 7 for connection to the water meter 5 and an interface 9 for connection to a meter reading device so that the quantity of water consumed may be read and the consumer may be charged appropriately. The interface 9 may be configured to provide the data for reading by an inductive pad, for example.

In addition to the detection of water consumption by a switch 3, the water meter 5 may also comprise a generator-type meter. The signal path front the generator-type meter (not shown) is conditioned for low impedance and power extraction, and signals are passed via a buffer (not shown) to a microcontroller 11. The signal received from the generator-type meter may be used in conjunction with the signal from the switch-type meter, to which the present invention primarily relates, by the microcontroller 11 to improve the accuracy of the determination of water consumption.

In this embodiment, to determine the correct status of the switch 3 of a water meter, a "signature" (i.e., a signal distinguishable from electromagnetic noise, such as a signal comprising a pre-defined binary code, a unique frequency characteristic, or other distinguishable feature is applied to the switch in order to verify its status whenever a switching event is detected. Thus, operation of the switch is determined by (i) event detection, and (ii) event verification. Only when detection and verification both occur is a true switch event deemed to have occurred, and is passed to appropriate further event processing.

The switch status sensor 1 comprises, in addition to microcontroller 11, an optional filter 13, connected to the microcontroller via FET switch 15, and a buffer 17. Port A of the microcontroller 11 is connected to the first terminal of the switch 3 of the water meter 5. The second terminal of the switch 3 at the water meter 5 is connected to the input at the filter 13. The output of the filter 13 is applied to the buffer 17 and port C of the microcontroller 11. The output of the buffer 17 is input to port D of the microcontroller 11. Port B of the microcontroller 11 controls by the FET switch 15 the operation of the filter 13, so that it may be operational or non-operational as appropriate. Port A of the microcontroller 11 controls the signal applied to the switch 3 of the water meter 5, and port D of the microcontroller 11 monitors the signal received from the switch 3 of the water meter 5, applied via filter 13 (if provided) and buffer 17.

Port C controls the current flowing through the switch 3. Port C can enable either a high or low current to be applied to the switch. The purpose of the control provided by port C is to minimize the current drain should the switch 3 remain closed for a fairly long period of time, which is a real likelihood in water meter reading. Some water meters cause the switches to be closed for extensive rotational periods of up to 70 percent.

The ports A, B, C and C of the microcontroller 11 are operated to provide the following states to efficiently and accurately measure a switch event by switch 3 of the water meter 5.

State 1

Port A is set to provide a constant signal to switch 3 (Logic 1);

Port B turns the filter 13 on;

Port C enables a high current to be drawn; and

Port D is set to detect a switch event, i.e. a change in the signal received from switch 3 via the filter 13 (if provided) and the buffer 17.

When an input signal is detected at port D the microcontroller 11 enters state 2.

State 2

Port B turns the filter 13 off;

Port A applies the "signature" to the switch 3; and

Port D is monitored to detect the presence at the "signature".

If the "signature" is received at port D of the microcontroller 11, it is determined that the switch 3 is closed. The microcontroller will then enter state 3.

State 3

Port A is set to provide a constant signal (Logic 1);

Port B turns the filter 13 on;

Port C is set to enable a low current; and

Port D is set to detect a switch event, i.e. a change in the signal received from switch 3 via the filter 13 (if provided) and the buffer 17.

When an event is detected at port D the microcontroller then enters state 4.

State 4

Port B turns the filter 13 off;

Port C enables a high current;

Port A applies the "signature" to the switch 3; and Port D is monitored by microcontroller 11 for receipt of the "signature".

If the "signature" is not detected at port D, this indicates that the switch 3 is now open, and the microcontroller 11 will record a valid pulse of the switch 3, and will return to state 1. The number of pulses are counted by the microcontroller 11, and the count may be made available to meter reading apparatus (not shown) via the interface 9.

The above states are activated in succession when the events observed at port D are valid switch openings and closures. If the "signature" is not detected at step 2, or the "signature" is detected at state 4, then the microcontroller 11 will register that the event provisionally detected in state 1 or 3 was not a true switch event, but was caused by noise. If the "signature" is not detected at state 2 or is detected at state 4, then the microcontroller returns to the preceding state, as appropriate.

In the above embodiment, a filter 13 is provided to minimize the number of times a provisional switch event is recorded at port D of the microcontroller 11, in order to reduce the number of times that the microcontroller 11 attempts to transmit the "signature" through the switch 3, to reduce power consumption. However, the filter only has to reduce the number or false event detections at port D of the microcontroller 11 and does not have to be designed to eliminate all the false switching events, as is done in the prior art. Thus, the filter does not have to unduly affect the responsiveness of the microcontroller to rapid switch pulses in contrast to the prior art. In an alternative embodiment, the filter 13, and consequently the switch 15 and port B of the microcontroller 11, may be dispensed with completely.

The switch status sensor 1 is preferably powered by lithium cells, which can comfortably withstand a reverse current flow of many milliamps, especially if of a transitory nature. This allows the battery to be charged when connected to interface 5 and/or interface 9.

While specific embodiments of the invention have been shown and described in detail to illustrate the application of the principles of the invention, it will be understood that the invention may be embodied otherwise without departing from such principles.

What is claimed is:

1. A switch status sensor for connection to a switch, the switch status sensor comprising:

a current detector that is configured to provide an indicated status of the switch, a signal generator that is configured to apply a signal to the switch, so that the signal passes through the switch when the switch is closed, and does not pass through the switch when the switch is open, and a signal detector that is configured to detect a communication of the signal via the switch, and thereby determine a verified status of the switch, and wherein the signal generator applies the signal to the switch in response to the indicated status of the switch from the current detector.

2. A switch status sensor according to claim 1, wherein the indicated status corresponds to the switch being opened.

3. A switch status sensor according to claim 1, wherein the indicated status corresponds to the switch being closed.

4. A switch status sensor according to claim 1, further including a filter, operably coupled to the switch and the current detector, that is configured to filter signals communicated between the switch and the current detector.

5. A switch status sensor according to claim 4, further including a switch that is configured to selectively disable the filter.

6. A switch status sensor according to claim 1, further comprising:

a counter that is configured to contain a count of changes in the verified status of said switch, and an interface that is configured to make the count available to external apparatus.

7. A switch status sensor according to claim 1, further comprising a current controller that is configured to control current applied to the switch to reduce power consumption by the switch status sensor.

8. A switch status sensor according to claim 1, wherein at least one of: the current detector, the signal generator, and the signal detector are embodied in a microprocessor.

9. A water meter for measuring a flow of water comprising:

a switch that is configured to change state in dependence upon the flow of water, and a switch status sensor comprising:

a current detector that is configured to provide an indicated state of the switch, a signal generator that is configured to apply a signal to the switch, so that the signal passes through the switch when the switch is closed, and does not pass through the switch when the switch is open, and a signal detector that is configured to detect a communication of the signal via the switch, and thereby determine a verified state of the switch, and wherein the signal generator applies the signal to the switch in response to the indicated state of the switch from the current detector.

10. A switch status sensor circuit adapted for connection to an electrical switch, comprising:

a current detector responsive to an electrical current flowing through a connection from the switch to the current detector, to determine changes in status of the switch and a signal generator responsive to the status of the switch, for supplying a signal to the switch, so that the signal passes through the switch when the switch is closed, and does not pass through the switch when the switch is open, and a switch status verifier that is configured to sense communication of the signal through the switch, to test whether the status that is determined by the current detector is correct.

11. A switch status sensor according to claim 10, wherein the status of the switch corresponds to the switch being opened.

12. A switch status sensor according to claim 10, wherein the status of the switch corresponds to the switch being closed.

13. A switch status sensor according to claim 10, wherein a filter is provided for filtering the electrical current flowing through the connection from the switch.

14. A switch status sensor according to claim 13, wherein said filter is configured to be selectively disabled during detection of said electrical current.

15. A switch status sensor according to claim 10, further comprising:

a counter that is configured to accumulate a count that corresponds to changes in the status of the switch, and an interface that is configured to make the count available to external apparatus.

16. A switch status sensor according to claim 10, further comprising a current controller that is configured to control the electrical current applied to the switch, to reduce power consumption by the switch status sensor.

17. A water meter for measuring a flow of water comprising:

a switch that is configured to change state in dependence upon the flow of water, and a switch status sensor comprising:

a current detector responsive to an electrical current flowing through a connection from the switch to the current detector, to determine changes in status of the switch and a signal generator responsive to the status of the switch, for supplying a signal to the switch, so that the signal passes through the switch when the switch is closed, and does not pass through the switch when the switch is open, and a switch status verifier that is configured to sense communication of the signal through the switch, to test whether the status that is determined by the current detector is correct.

* * * * *